US010859338B2

(12) United States Patent
Polanich

(10) Patent No.: US 10,859,338 B2
(45) Date of Patent: Dec. 8, 2020

(54) COUNTERACTING PULLEY BLOCK

(71) Applicant: SERPENT RURAL SPORTS LLC, Los Gatos, CA (US)

(72) Inventor: Jonathan C. Polanich, Los Gatos, CA (US)

(73) Assignee: SERPENT RURAL SPORTS LLC, Los Gatos, CA (US)

( * ) Notice: Subject to any disclaimer, the term of this patent is extended or adjusted under 35 U.S.C. 154(b) by 0 days.

(21) Appl. No.: 16/749,861

(22) Filed: Jan. 22, 2020

(65) Prior Publication Data

US 2020/0318930 A1 Oct. 8, 2020

Related U.S. Application Data

(60) Provisional application No. 62/830,741, filed on Apr. 8, 2019.

(51) Int. Cl.
*F41B 5/10* (2006.01)
*F41B 5/12* (2006.01)

(52) U.S. Cl.
CPC ..... *F41B 5/105* (2013.01); *F41B 5/123* (2013.01)

(58) Field of Classification Search
CPC ..... F41B 5/10; F41B 5/105; F41B 5/123
See application file for complete search history.

(56) References Cited

U.S. PATENT DOCUMENTS

| | | | | |
|---|---|---|---|---|
| 5,722,385 A * | 3/1998 | Bunk | F41B 5/10 | 124/25.6 |
| 8,567,376 B2 * | 10/2013 | Flint | F41B 5/12 | 124/20.3 |
| 10,107,584 B1 * | 10/2018 | Anderson | F41B 5/12 | |
| 10,514,226 B2 * | 12/2019 | Shaffer | F41B 5/123 | |
| 2009/0032002 A1 * | 2/2009 | Howard | F41B 5/0094 | 124/25.6 |

* cited by examiner

*Primary Examiner* — John A Ricci
(74) *Attorney, Agent, or Firm* — Innovation Capital Law Group, LLP; Vic Lin

(57) ABSTRACT

Within a counteracting block and tackle system of compact arrow launching devices, a cable-suspended, moveable pulley block structure permits the through clearance of razor-edged arrow broadheads and employs a plurality of low-density, solid sheaves, aligned in series to guide the in-line purchase of bowstring. The moveable pulley block has a hollow-though structure that permits the radial clearance of an arrow broadhead, reducing potential external interference or contact with the razor edges of the broadhead. The pulley block is attached to cable terminals at one end which allow the pulley block to travel in cooperating with cables. The pulley block has low-density, solid sheaves that facilitate high velocity launching cord travel with low rotational momentum for reduced friction and wear. The sheaves and cable terminals, and any launching cord terminals, are aligned in series and share a single linear plane to minimize launching cord fleet angles, reduce friction and increase efficiency.

20 Claims, 7 Drawing Sheets

COUNTERACTING PULLEY BLOCK

CROSS-REFERENCE TO RELATED APPLICATIONS

This application claims the benefit of priority of U.S. provisional patent application No. 62/830,741, filed Apr. 8, 2019, the contents of which are herein incorporated by reference.

BACKGROUND OF THE INVENTION

1. Field of the Invention

Embodiments of the invention relate generally to counteracting block and tackle pulley systems within compact arrow launching devices. Particularly, embodiments of the invention relate to cable-suspended, moveable pulley blocks and associated pulleys that extend and retract a launching cord in a general serpentine path in launching arrows with razor broadhead tips.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Conventional systems of guiding the extension and retraction of a launching cord within counteracting block and tackle systems used in compact arrow launching devices are known. These systems have relied on bridge type pulley blocks and miniature pulley bearings arranged in parallel to perform these methods.

However, these conventional systems have limitations. While bridge type pulley blocks have demonstrated functional reliability, their structure does not fully surround the exposed edges of razorblade broadhead arrow tips. Additionally, the parallel pulley design introduces fleet angles into the serpentine path of the launching cord which creates additional friction against the edges of the pulleys.

Many prior art systems have demonstrated durable use of miniature, small circumference, metal ball bearing pulleys. While these pulleys are strong enough to operate for thousands of cycles in the confined spaces of a reverse block and tackle system within compact arrow launching devices, they do so at the expense of the launching cord. The high density of metal pulleys generates significant momentum when deployed at high RPMs. These systems rely on the surface friction of the launching cord to arrest the spinning pulleys, which generates enough combined heat and wear that even the toughest launching cords fail in as little as 5-10 launch cycles.

While lower density bearings and have demonstrated utility in many industrial applications, the environmental and operating conditions of counteracting block and tackle pulley systems within compact arrow launching devices poses a unique set of requirements unsuitable for the majority of lower density materials. For example, small circumference ceramics bearings have proved useful in many industrial applications, however they are too brittle and fracture under the shock loading forces inherent in counteracting block and tackle systems within compact arrow launching devices. Many pulleys do not possess combinations of mechanical properties, including density, compressive strength, tensile modulus, glass transition temperature, coefficient of friction, and moisture absorption to perform reliably in these dynamic systems and/or the operating environment.

It is therefore an object of the present invention to provide a counteracting block and tackle system that can overcome the above limitations.

SUMMARY OF THE INVENTION

Aspects of the present invention are achieved by providing a moveable pulley block having a hollow-though structure with an inner radial clearance of the cutting profiles of razor broadheads arrow tips. The hollow-through pulley block structure has opposing sides flanking the hollow-through relief, where each side can be fitted with pulley mounts. An at least one low-density, solid pulley sheave can be mounted in each side or in series along each side when there are two or more sheaves. The sheaves can be aligned directly adjacent one another along each side, provided that any additional interior sheaves added are smaller in diameter, allowing bowstring clearance. Cable terminals can also be located at one end of the pulley block, on each side, in-series alignment with respect to the pulleys. In-series alignment of cable terminals and pulleys can position bowstring and cable on a single linear plane to minimize bowstring operating friction with virtually no fleet angles.

In other embodiments, launching cord or bowstring terminals can be located on the opposing end of the hollow-through pulley block, one on each side and aligned in series with the cable terminals and sheaves.

While all embodiments utilize solid, low density pulley sheaves, sheaves in typical embodiments have mechanical responses providing for low axle friction, shock absorption and dimensional stability during operational exposure to water and freezing ambient temperatures.

Other embodiments of the present invention can have captive or hook style cable terminals or bow string terminals.

Further embodiments of the present invention relate to an arrow rest or captive arrow rest that is mounted in the interior of the hollow-through pulley structure. The rest can position the arrow razor broadhead within the hollow-through structure and allows radial clearance of the structure. The embodiment eliminates the need for a long arrow support rail typically located along the top of the frame or barrel of many arrow launching devices, thereby further reducing friction and increasing system efficiency.

Additionally, embodiments of the present invention may exist at two locations within a counteracting block and tackle system, one embodiment counteracting against another, enjoined by a launching cord or bow string.

Embodiments of the present invention provide a pulley block system comprising at least one moveable pulley block having a hollow-though structure configured to receive a razor broadhead arrow tip positioned within the hollow-through space of the pulley block; at least two sheaves attached to opposing sides of each of the at least one moveable pulley block; and at least two cable terminals located at one end of each of the at least one moveable pulley block.

Embodiments of the present invention further provide a pulley block system comprising a moveable pulley block having a hollow-though structure configured to receive a razor broadhead arrow tip positioned within the hollow-through space of the pulley block; at least one sheave attached to at each opposing side of the pulley block; and at least one cable terminal located at one end of the pulley block, the at least one sheave and the at least one cable terminal are disposed in series along each opposing side of the pulley block.

Embodiments of the present invention also provide a pulley block system comprising a moveable pulley block having a hollow-though structure configured to receive a razor broadhead arrow tip positioned within the hollow-through space of the pulley block; at least two sheaves attached in series to at each opposing side of the pulley block; at least one cable terminal located at one end of the pulley block, the at least one sheave and the at least one cable terminal are disposed in series along each opposing side of the pulley block; and a launching cord terminal located on the end of each opposing side of the pulley block opposing respective cable terminals, wherein the at least one sheave, the at least one cable terminal, and the launching cord terminal on each opposing side of the pulley block are aligned in series and share a single linear plane.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
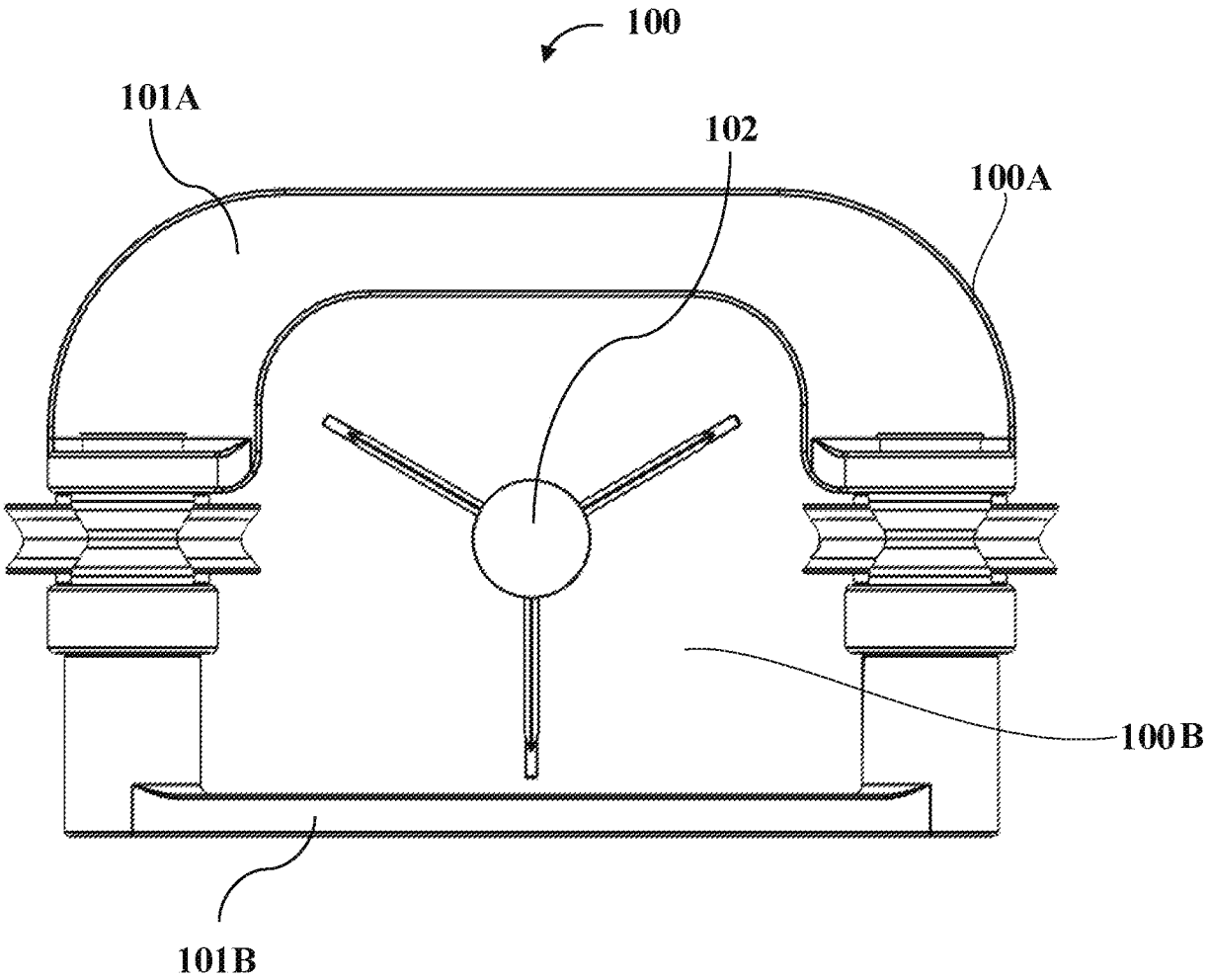
FIG. 1 is a front view of a pulley block system depicting the razor arrow broadhead within the hollow-through structure according to an exemplary embodiment of the present invention.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a moveable pulley block that has a hollow-though structure permitting the radial clearance of an arrow broadhead, reducing potential external interference or contact with the razor edges of the broadhead. The pulley block is attached to cable terminals at one end which allow the pulley block to travel in cooperating with cables. The pulley block has low-density, solid sheaves that facilitate high velocity launching cord travel with low rotational momentum for reduced friction and wear. The sheaves and cable terminals, as well as any launching cord terminals, are aligned in series and share a single linear plane to minimize launching cord fleet angles, reduce friction and increase efficiency.

Referring to FIGS. 1 through 6, wherein like reference numerals refer to like components in the various views, there is illustrated therein a new and improved pulley blocks system 100, also simply referred to as system 100.

As illustrated in FIG. 1, in accordance with the embodiment of the present invention, the pulley block system 100 has a pulley block 100A with a hollow-through structure 100B. In the present configuration, the hollow-though structure 100B can be formed between an upper block structure 101A and a lower block structure 101B. Clearance for an arrow razor broadhead 102 is provided within the hollow-though structure 100B of the pulley block 100A such that it provides sheathing of the razor blades. The pulley structure 100A may surround the entire 360 degrees of the radial profile of the arrow razor broadhead 102 but may be a little as 180 degrees. Alternatively, the upper block structure 101A and the lower block structure 101B may be a single united structure.

Figure 2:
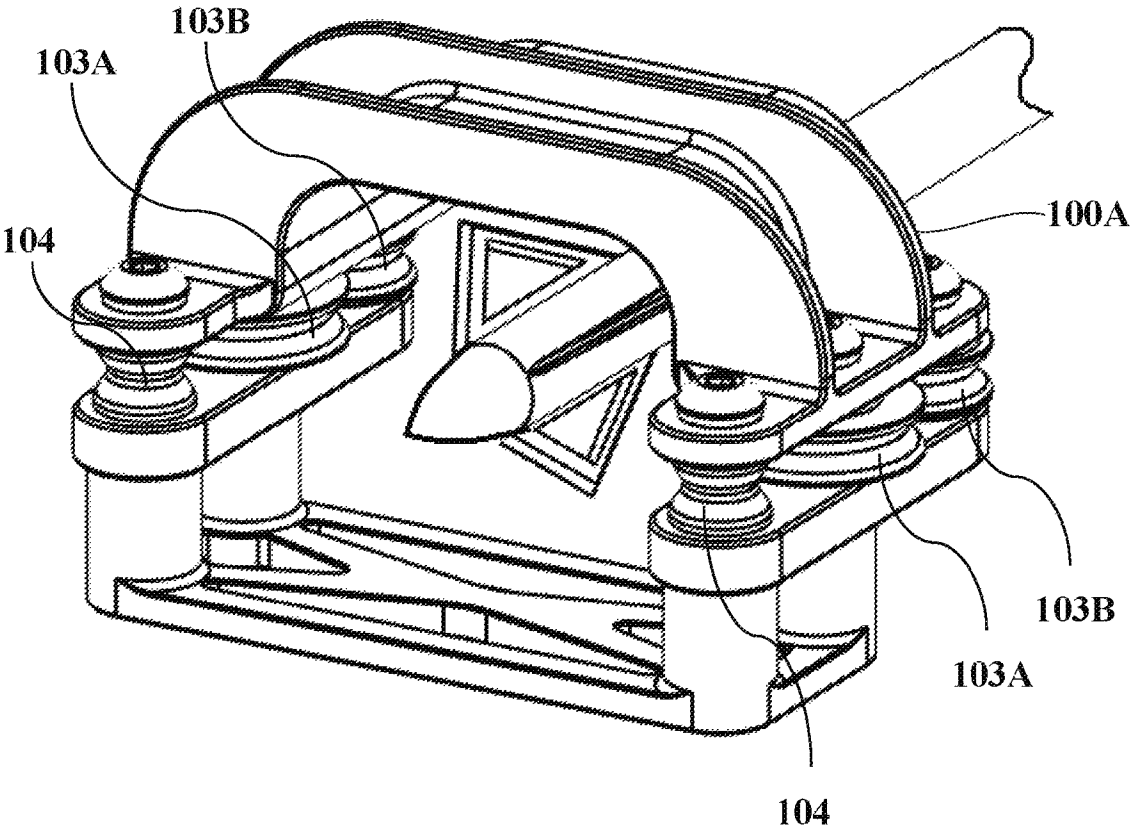
FIG. 2 is a perspective view of the configuration in FIG. 1.

As shown in FIG. 2, a pair of cable terminals 104 is located at one end of the pulley block 100A. Each cable terminal is adjacent the other on each side of the pulley block 100A. As well, at least one pair of low-density, solid sheaves 103A is attached to the pulley block 100A. Each low-density, solid sheave 103A is located directly behind a respective cable terminal 104 along each flank of the pulley block 100A. In configurations where an optional additional pair of low-density, solid sheaves 103B are included, as shown in FIG. 2, they can be located in series alignment behind the first set of solid sheaves 103A.

Figure 3:
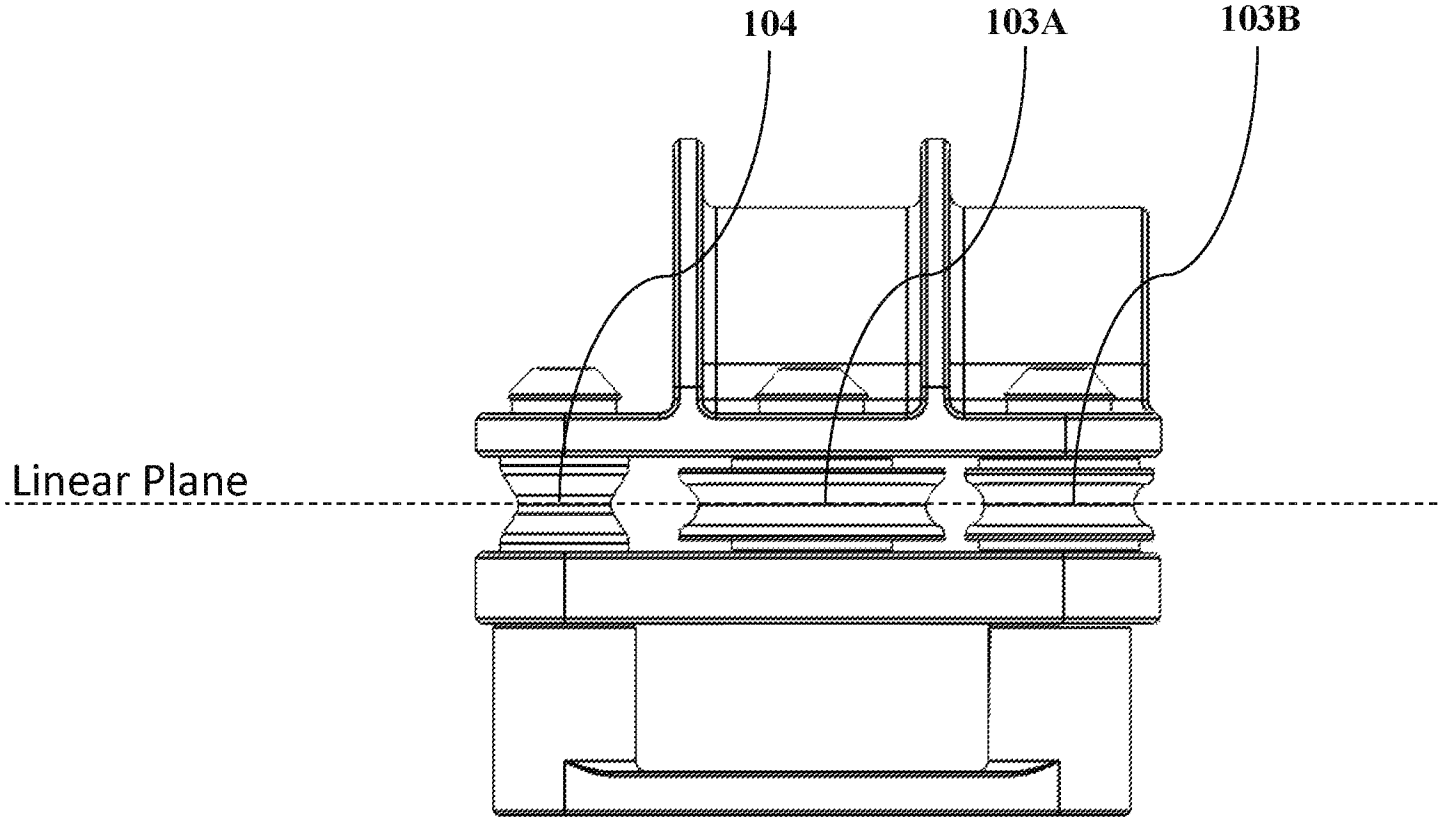
FIG. 3 is a side elevation view FIG. 1 compared with an alignment reference of a single linear plane.

As illustrated in FIG. 3, along the sides of the pulley block the cable terminals 104, low-density, solid sheaves 103A and 103B can all be vertically aligned such that they share a single linear plane.

Figure 4:
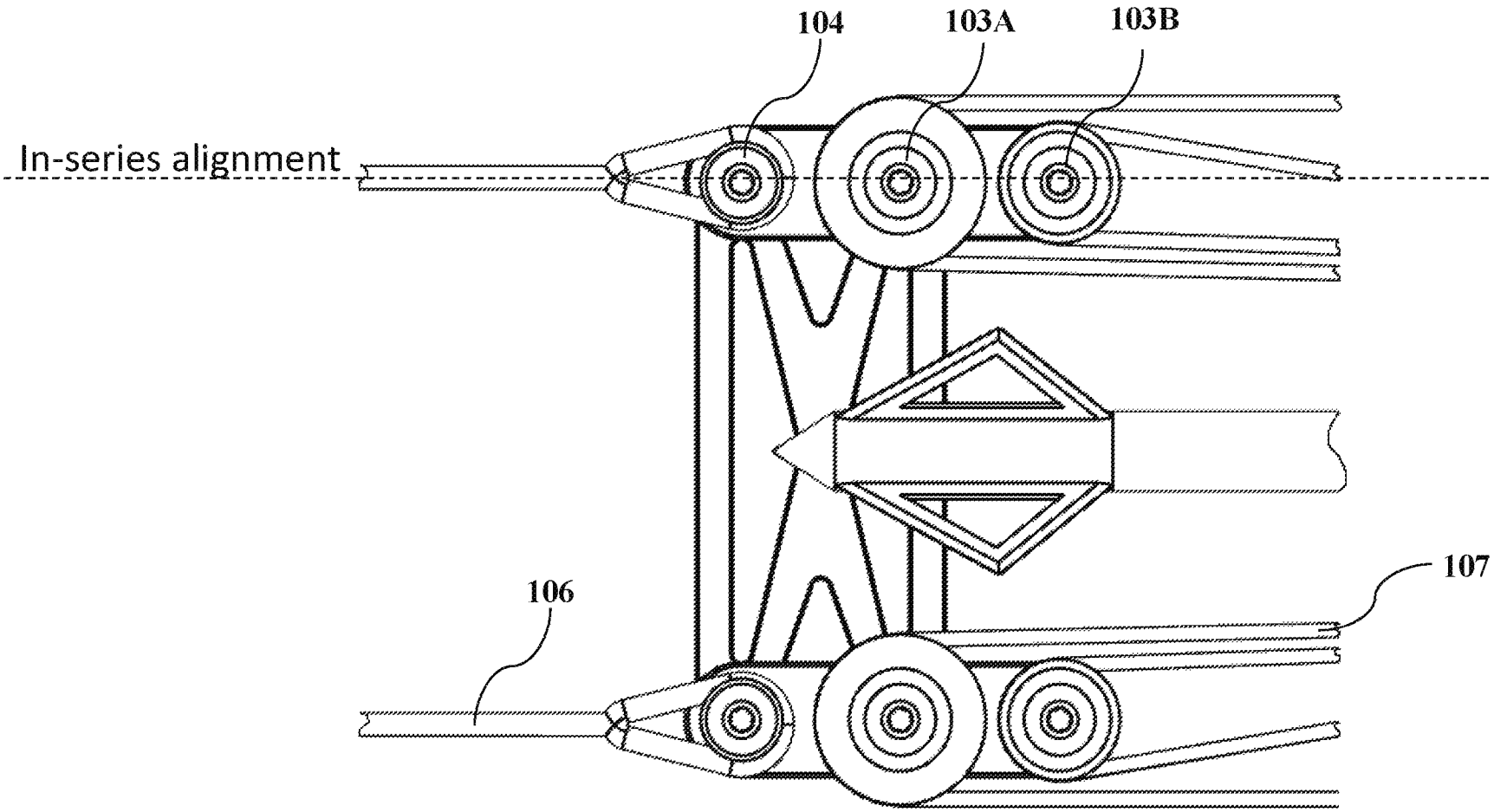
FIG. 4 is a top view of FIG. 1 depicting the components one side of the pulley block compared with an in-series alignment reference.

FIG. 4 shows a cable 106 attached to the cable anchor 104, followed by low-density, solid sheaves 103A and 103B such that they establish an in-series alignment on both sides of the pulley block. When an additional set of low-density, solid sheaves 103B are used they are smaller in diameter than the first pair 103A, maintaining operating separation between each section of the launching cord 107.

Figure 5:
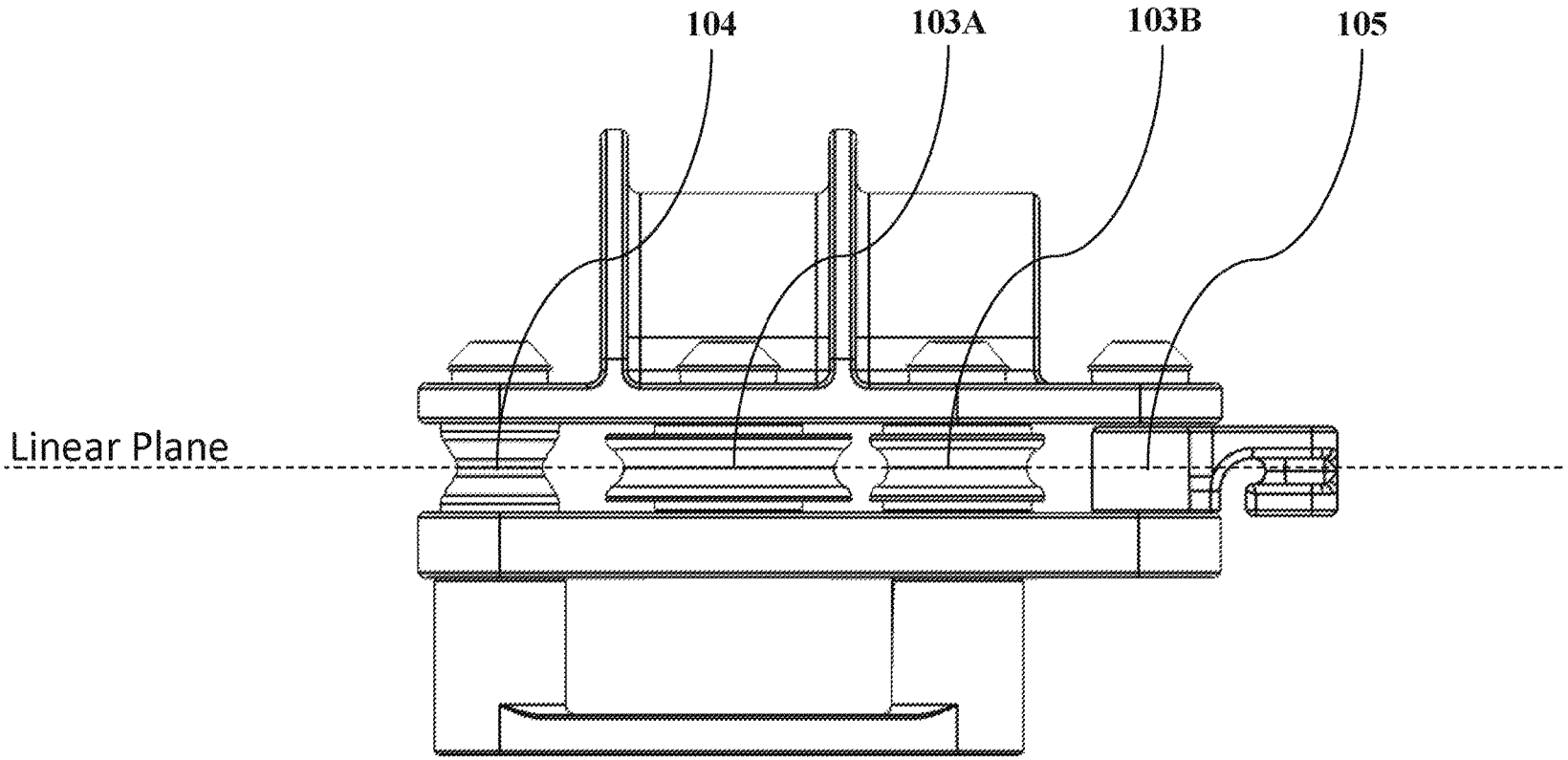
FIG. 5 is a side elevation of an embodiment demonstrating the components aligned in comparison with a single linear plane and with the addition of a launching cord hook type terminal.

As shown in FIG. 5, a configuration includes a pair of launching cord terminals 105. They are located at the opposing end of the pulley block from the cable terminals 104. They are vertically located on the same linear plane as the low-density, solid sheaves 103A and 103B and the cable terminals 105. It should be understood that launching cord terminals 105 depicted are a hook style but may be a captive style similar to the cable terminals 104.

Figure 6:
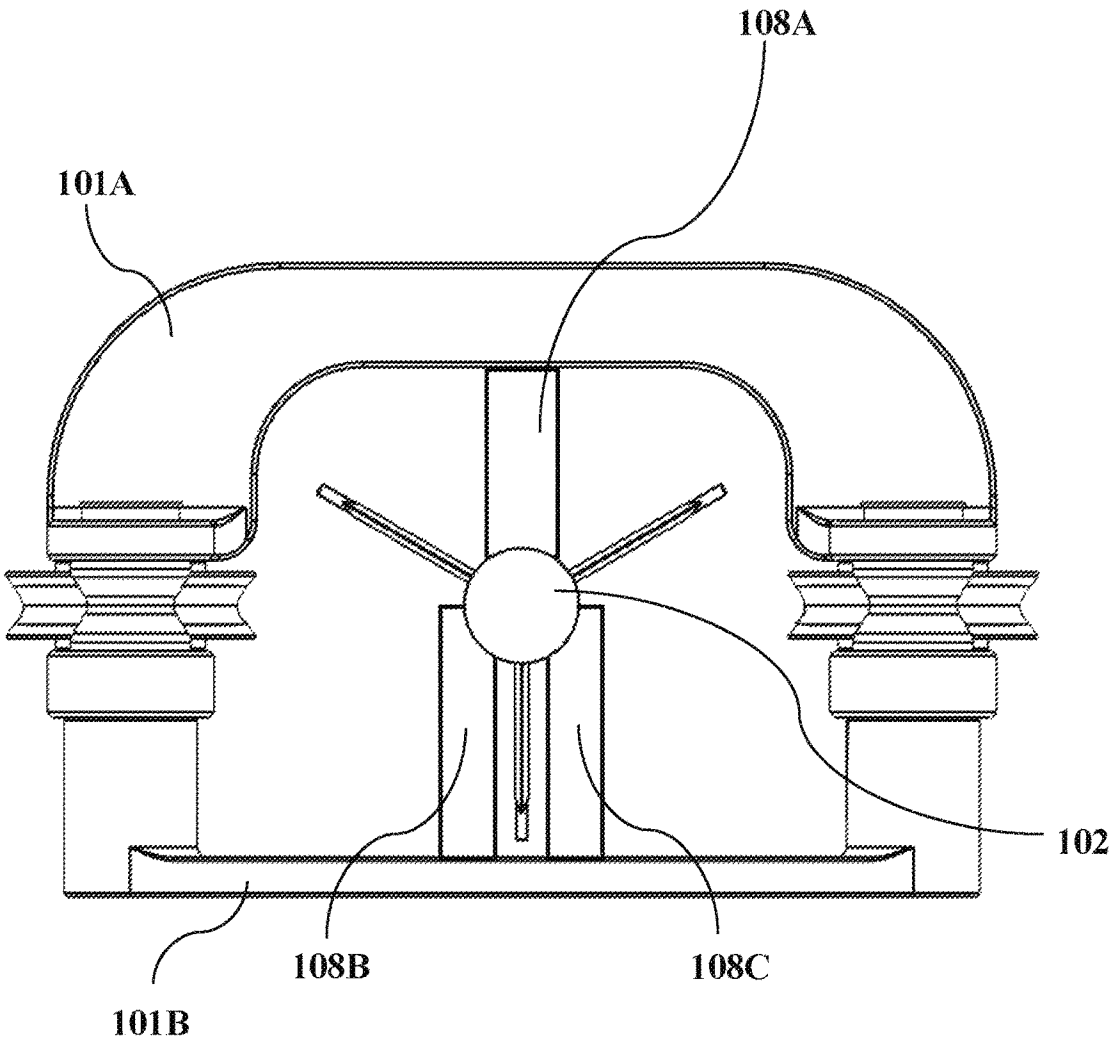
FIG. 6 is a front view of an embodiment including an arrow rest mounted within the pulley block hollow-through structure.

In FIG. 6 an arrow rest is shown, its structure includes upper member 108A mounted to the upper block structure 101A and lower arrow rest members 108B and 108C mounted to the lower block structure 101B such that it positions arrow razor broadhead 102 within the center of the hollow-through pulley block structure 100B.

Figure 7:
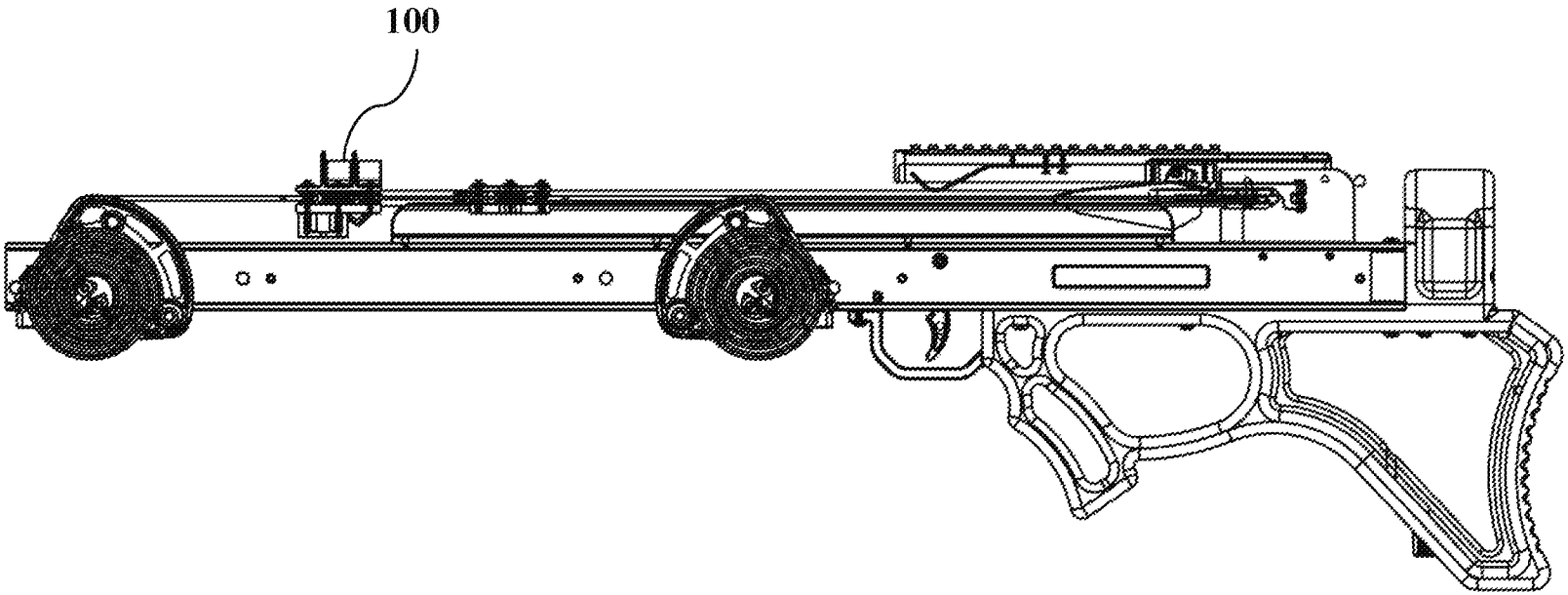
FIG. 7 is a side view of a system mounted as a part of a counteracting block and tackle within a compact arrow launching device.

As a means of providing broader context, FIG. 7 shows system 100 attached within a counteracting block and tackle assembly within a compact arrow launching device.

Hence, the various embodiments of the invention provide multiple benefits, which include the following: (1) the hollow-through block structure provides sheathing of the arrow broadhead tip, reducing the chances of unwanted, incidental contact between the razors and the user or the surrounding environment; (2) the in-series alignment of the low-density, solid sheaves reduces fleet angles and terminal sheave momentum thereby reducing bowstring friction and increasing the mechanical efficiency of the counteracting block and tackle system and increasing service life of the bowstring or launching cord; (3) additionally, systems that include an arrow rest within the hollow-through pulley block structure further reduces friction and increase counteracting block and tackle operating efficiency by eliminating the need for a long arrow rail typically found along the entire top length of the frame member of many arrow launching devices.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A pulley block system comprising:

at least one moveable pulley block having a hollow-though structure configured to receive a razor broadhead arrow tip positioned within the hollow-through space of the pulley block;

at least two sheaves attached to opposing sides of each of the at least one moveable pulley block; and at least two cable terminals located at one end of each of the at least one moveable pulley block.

2. The pulley block system of claim 1, where each of the at least two sheaves are solid, low-density sheaves.

3. The pulley block system of claim 1, further comprising as many as two launching cord terminals located on the end of each of the at least one moveable pulley block opposing respective cable terminals, each located on opposing sides of each of the at least one moveable pulley block.

4. The pulley block system of claim 3, wherein respective ones of the at least two sheaves, respective ones of the at least two cable terminals and respective ones of the launching cord terminals share a single planar alignment.

5. The pulley block system of claim 1, wherein the hollow-through structure maintains more than 180° radial clearance around a razor broadhead arrow profile when the razor broadhead arrow tip is positioned within the hollow-through space.

6. The pulley block system of claim 1, wherein the at least two sheaves are aligned in series along the sides of the pulley block structure.

7. The pulley block system of claim 1, wherein the least two sheaves include a pair of sheaves on each of the opposing sides of the at least one pulley block.

8. The pulley block system of claim 7, wherein the pair of sheaves are aligned in series along the sides of the pulley block structure.

9. The pulley block system of claim 1, wherein respective ones of the at least two sheaves and respective ones of the at least two cable terminals share a single planar alignment.

10. The pulley block system of claim 1, wherein each of the at least two solid sheaves have a specific gravity of less than 3 $g/cm^3$.

11. The pulley block system of claim 1, further comprising an arrow rest structure mounted within the hollow-through pulley block structure.

12. The pulley block system of claim 11, wherein the arrow rest structure includes at least one upper member extending from an upper block structure of the hollow-through pulley block structure and at least two lower members extending from a lower block structure of the hollow-through pulley block structure.

13. The pulley block system of claim 1, further comprising two of the moveable pulley blocks coupled together via a launching cord.

14. The pulley block system of claim 13, wherein the launching cord is a bowstring.

15. A pulley block system comprising:

a moveable pulley block having a hollow-though structure configured to receive a razor broadhead arrow tip positioned within the hollow-through space of the pulley block;

at least one sheave attached to at each opposing side of the pulley block; and at least one cable terminal located at one end of the pulley block, the at least one sheave and the at least one cable terminal are disposed in series along each opposing side of the pulley block.

16. The pulley block system of claim 15, further comprising a launching cord terminal located on the end of each opposing side of the pulley block opposing respective cable terminals.

17. The pulley block system of claim 16, wherein the at least one sheave, the at least one cable terminal, and the launching cord terminal on each opposing side of the pulley block are aligned in series and share a single linear plane.

18. The pulley block system of claim 15, wherein the hollow-through structure maintains more than 180° radial clearance around a razor broadhead arrow profile when the razor broadhead arrow tip is positioned within the hollow-through space.

19. A pulley block system comprising:

a moveable pulley block having a hollow-though structure configured to receive a razor broadhead arrow tip positioned within the hollow-through space of the pulley block;

at least two sheaves attached in series to at each opposing side of the pulley block;

at least one cable terminal located at one end of the pulley block, the at least one sheave and the at least one cable terminal are disposed in series along each opposing side of the pulley block; and a launching cord terminal located on the end of each opposing side of the pulley block opposing respective cable terminals, wherein the at least one sheave, the at least one cable terminal, and the launching cord terminal on each opposing side of the pulley block are aligned in series and share a single linear plane.

20. The pulley block system of claim 19, wherein the hollow-through structure maintains more than 180° radial clearance around a razor broadhead arrow profile when the razor broadhead arrow tip is positioned within the hollow-through space.

* * * * *